United States Patent [19]

Bako

[11] Patent Number: 4,520,641

[45] Date of Patent: Jun. 4, 1985

[54] COMBINATION LOCK WITH SECURITY FEATURE

[75] Inventor: Lazlo Bako, Woodcliff Lake, N.J.

[73] Assignee: Presto Lock, Inc., Garfield, N.J.

[21] Appl. No.: 330,694

[22] Filed: Dec. 14, 1981

[51] Int. Cl.[3] ..... E05B 37/02

[52] U.S. Cl. ..... 70/312; 70/314; 70/316

[58] Field of Search ..... 70/312, 314, 315–319, 70/67, 69–76; 235/131 R, 131 JA

[56] References Cited

U.S. PATENT DOCUMENTS

| | | | |
|---|---|---|---|
| 827,191 | 7/1906 | Strong | 70/314 |
| 1,348,621 | 8/1920 | Ashton | 70/314 |
| 3,321,134 | 5/1967 | Sigl | 235/144 |
| 3,413,828 | 12/1968 | Harrell | 70/314 |
| 3,529,769 | 9/1968 | Howard | 235/144 |
| 3,563,067 | 2/1971 | Foote | 70/314 X |
| 3,633,388 | 1/1972 | Atkinson | 70/80 |
| 3,677,042 | 7/1972 | Atkinson | 70/312 X |
| 3,766,760 | 10/1973 | Mohrhauser et al. | 70/314 |
| 3,942,344 | 3/1976 | Gehrie et al. | 70/70 |
| 4,028,530 | 6/1977 | Bud et al. | 235/144 |
| 4,111,014 | 9/1978 | Epstein | 70/312 X |
| 4,197,452 | 4/1980 | Sato | 235/144 |
| 4,221,327 | 9/1980 | Sato et al. | 235/144 |
| 4,343,163 | 8/1982 | Scelba et al. | 70/312 |
| 4,354,366 | 10/1982 | Bako | 70/318 X |

FOREIGN PATENT DOCUMENTS

| | | | |
|---|---|---|---|
| 207684 | 12/1923 | United Kingdom | 70/314 |
| 2067649 | 7/1981 | United Kingdom | 70/312 |

*Primary Examiner*—Gary L. Smith
*Assistant Examiner*—Lloyd A. Gall
*Attorney, Agent, or Firm*—Shapiro and Shapiro

[57] ABSTRACT

A multi-dial combination lock is provided with a security feature whereby the dials are rotated when the lock is opened in order to upset the on-combination setting of the dials. Each dial has a heart-shaped cam and a cam operator is provided including followers for the respective cams. When the lock is set on-combination, and an actuator is moved manually in order to open the lock, the actuator also works the cam operator so as to apply pressure to the cam formations on the respective dials effective to rotate each of the dials into a set orientation. In the set orientation to which the dials are rotated, each dial may be orientated so as to display the same combination indicium, e.g. "0". The lock also includes a shift member for changing the set combination of the dials, the shift member being situated in a pocket formed in the manual actuator.

25 Claims, 9 Drawing Figures

COMBINATION LOCK WITH SECURITY FEATURE

BACKGROUND OF THE INVENTION

This invention relates to combination locks of the type having a plurality of manually movable elements, such as combination dials, which must each be brought into a predetermined orientation, to establish the on-combination setting of the lock, and enable the lock to be opened.

Combination locks of the above type are well known and in common use. One problem which has occurred with such locks, is that once the combination required to open the lock has been set, and the lock has been opened, unless positive action is taken to obscure or upset the combination, it may remain visible. Accordingly, the lock may be susceptible to having its correct combination read and memorized by unauthorized personnel, who may then be in a position to open the lock. The present invention provides a solution to this problem.

SUMMARY OF THE INVENTION

In accordance with the invention, a combination lock of the type described is provided with upsetting means for changing the setting of the manually movable elements from the on-combination setting to another setting when the lock is opened. Thus, the upsetting means may be adapted to move at least one of the movable elements from the particular orientation in which it is disposed in order to open the lock, into another set orientation, when the lock is opened. The upsetting means further, may be adapted to move each element from the particular orientation in which it is disposed in order to open the lock, into another set orientation, and, where the elements are rotary dials, for example, with peripheral combination indicia, in the set orientation to which the dials are moved, they may each display the same indicium, e.g. "0".

In one preferred form of the invention, the lock may include a locking member, such as a fence or bolt, controlled by rotary dials, and a manual actuator associated with the locking member and which can only be moved to open the lock when each dial is rotated into a particular orientation in which the locking member is released. The upsetting means may include a cam formation on each dial, which when suitable pressure is applied thereto by a follower, is adapted to cam the dial from said particular orientation into the set orientation. A drive arrangement may be provided between the manual actuator and a cam operator which is provided with a cam follower for each dial, so that when the manual actuator is used to open the lock, it also serves as a means for camming each dial from the particular orientation required to open the lock, into the other set orientation.

Additional features of the invention, including, for example, a novel form of shift mechanism, which allows the combination of a lock to be varied, will be apparent from the ensuing description and claims taken in conjunction with the attached drawings.

DESCRIPTION OF PREFERRED EMBODIMENT

Figure 1:
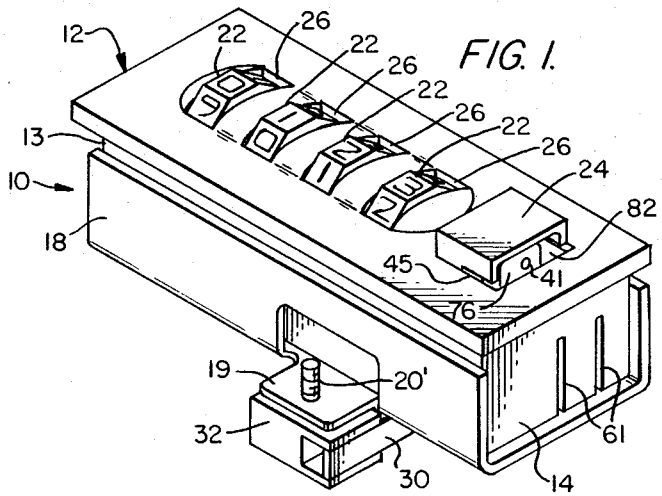
FIG. 1 is a perspective view of a lock in accordance with the invention.
Figure 2:
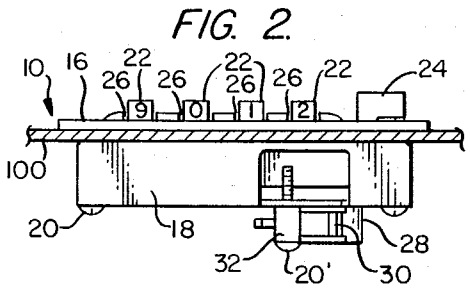
FIG. 2 is a front elevational view of the lock in locked position.
Figure 3:
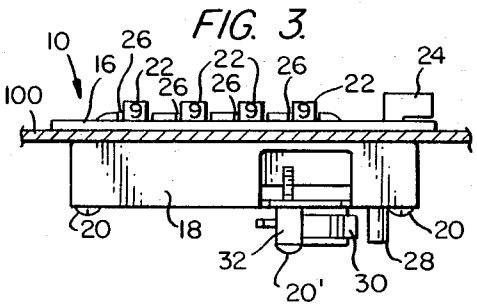
FIG. 3 is a view similar to FIG. 2 but showing the lock in open position.

Referring initially to FIGS. 1–3, a combination lock, generally indicated by reference 10, includes a casing 12 formed integrally with front and back walls 13, side walls 14, and a top plate (faceplate) 16, a U-shaped base plate 18 attached to the casing, e.g., by screws 20, a locking mechanism including rotary dials 22, with peripheral combination indicia, and a manual actuator 24. Parts of the dials project through dial-setting openings 26 in top plate 16 and the manual actuator projects through an actuator opening 45. Actuator 24 has a depending post 28 adapted to move a sprung operating arm 30 of an electric switch 32 between on and off positions, when actuator 24 is moved in a manner to be described. Switch 32 may be attached to a tab 19 on base plate 18, e.g., by screws 20', and may, for example, be used to electrically control any suitable function, e.g., the opening and closing of a member, such as a door, a cabinet drawer, or the like. A plate 100 of an article on which the lock is used may be provided with a lock-receiving opening, and the edges of the plate around the opening may be trapped between the edges of plate 16 and the opposite top edges of plate 18.

(While the lock 10 is described herein as working the operating arm of an electric switch, this is only exemplary of the uses to which locks embodying the invention may be put, and this application of the lock is not limiting as to the scope of the invention. The principles of the invention may be applied in diverse forms of combination locks, e.g., locks of the type which control a mechanical latching member rather than an electrical switch. Thus, actuator 24 could, for example, be used to mechanically disengage a latch element from a hasp or the like, where the lock is to be used on articles such as pieces of luggage.)

Reverting to the illustrated embodiment, FIGS. 1 and 2 show lock 10 with the actuator and post in a left-hand locked position and FIG. 3 shows the lock with the actuator and post moved to the right into an unlocked position. In moving from the locked to the unlocked position, the post 28 allows arm 30 to spring from one position to another, thereby actuating switch 32.

To enable actuator 24 to be moved to the right from the locked position, it is necessary for each of the dials 22 to be rotated into a particular orientation in which a particular indicium is displayed in uppermost position in the respective opening 26. When all the dials have been properly orientated, establishing the on-combination setting of the lock, only then can the actuator be moved to the right, thereby opening the lock and operating switch 32. Also, movement of actuator 24 to the right is effective to operate an upsetting mechanism internally of the lock, for rotating each dial from its on-combination orientation into another set orientation. The on-combination setting of the lock is thereby obscured and is no longer visible in openings 26. In the set orientation to which each dial is rotated when actuator 24 is moved to the right, a like indicium (e.g., "0") is preferably uppermost on each dial in the respective opening 26.

When the lock is open, actuator 24 remains in the right-hand position until manually returned to the left. Return movement of actuator 24 is operative through post 28, to return arm 30 to its initial position and this may operate switch 32 in a reverse mode to its previous operation, dependent on the particular functioning of the switch, which forms no part of the present invention. To subsequently reopen the lock, the correct combination which was upset when the lock was previously opened, must be reset by suitably orientating the dials.

The internal construction of lock 10, which provides the above operating characteristics, will now be described with particular reference to FIGS. 4–9.

Figure 4:
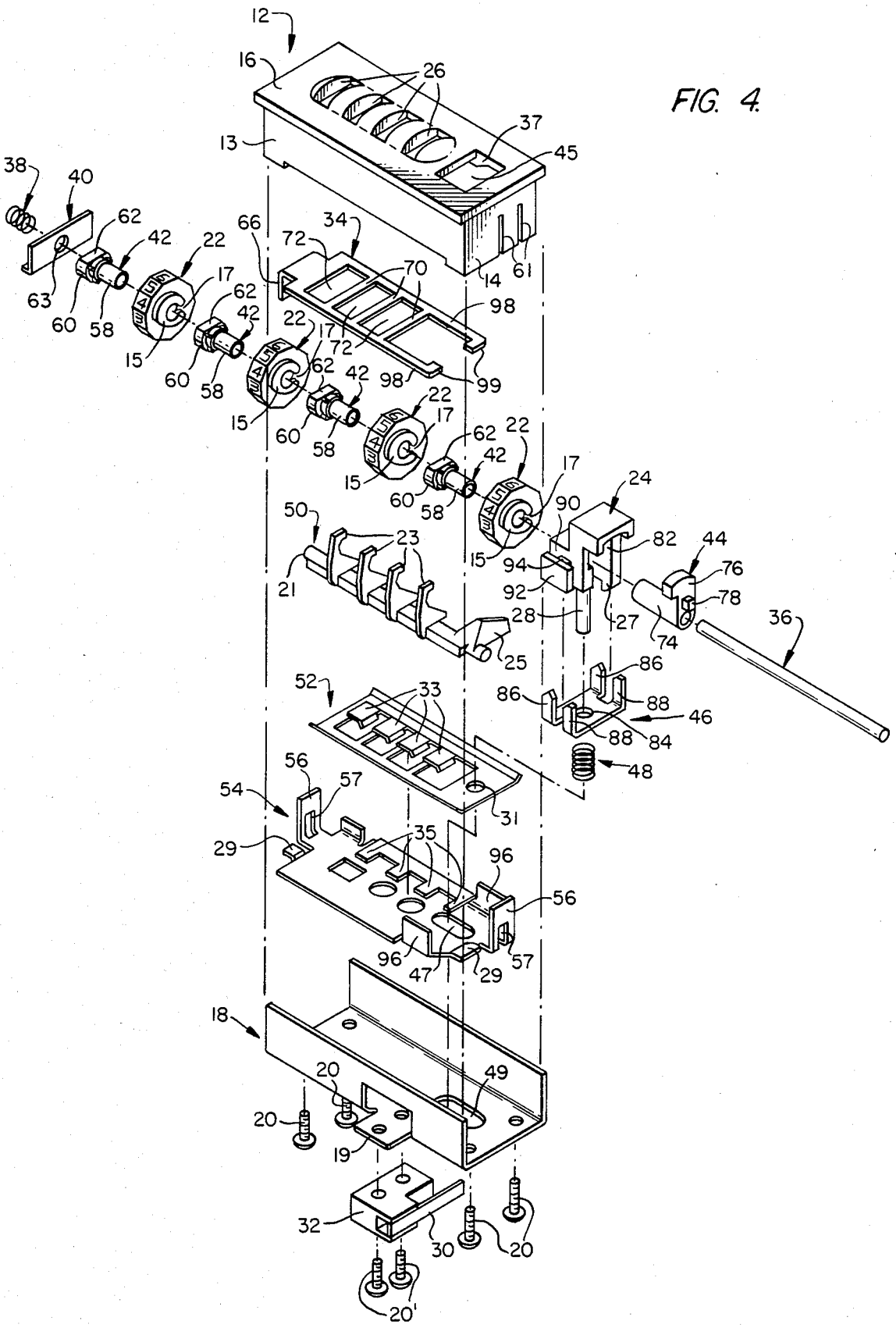
FIG. 4 is an exploded perspective view of the lock.

The internal lock components are best seen individually in FIG. 4. These comprise a locking member in the form of a generally planar fence or bolt 34, a shaft 36, a shaft spring 38, a bracket 40, combination sleeves 42, the dials 22 (the illustrated lock has four sleeves and four dials, but this number can be varied), the manual actuator 24, a shift member 44, a coupling member 46, a coupling spring 48, a cam operator 50, a dial spring member 52, and a frame member 54.

Frame member 54 rests adJacent the bottom wall of base plate 18, and the frame member has upstanding tabs 56 at its opposite ends with openings 57 which snap resiliently over ramp portions 59 of casing side walls 14 (see FIGS. 6 and 9) to hold the frame member in position. The casing side walls may be slit as shown at 61 in FIG. 1 to provide resiliency in the ramp portions. Tabs 56 also support shaft 36 in recesses in walls 14, the shaft sliding into the recesses from below.

Figure 5:
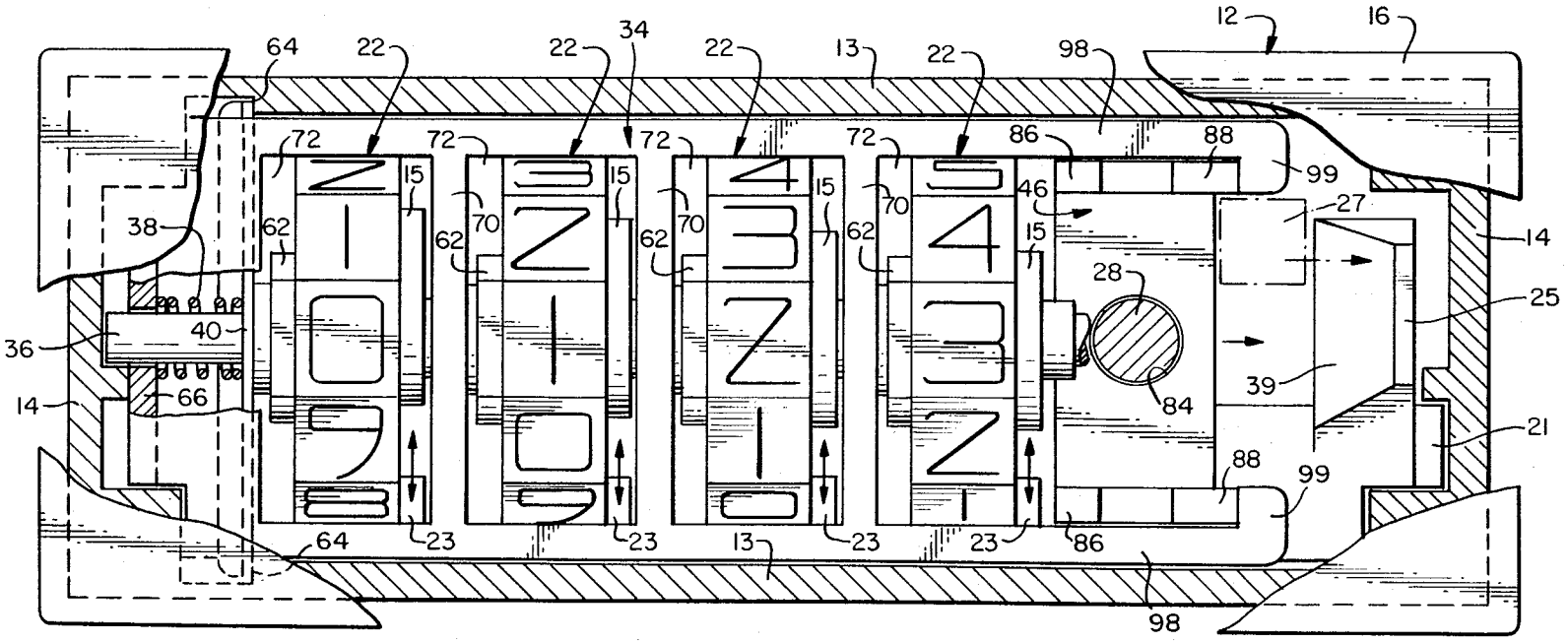
FIG. 5 is a top plan view with parts of the lock broken away.

Sleeves 42 and dials 22 are rotatably mounted on the shaft, with the dials rotatably coupled to the sleeves, in conventional manner, by inter-engaging teeth or the like. Each sleeve has a bearing section 58 on which the respective dial fits, and an enlarged boss 60 at one end, which is generally cylindrical except for a flat 62. The dials and sleeves are mounted on the shaft in axially adjacent positions, between bracket 40 and shift member 44. Bracket 40 fits onto shaft 36 through an opening 63 in the bracket, and the edges of the bracket fit against internal shoulders 64 at the ends of grooves in the casing walls as seen in FIG. 5, the grooves allowing the bracket to move when the sleeves are moved by the shift member. On the outside of bracket 40, i.e., to the left in the drawings, the shaft carries the compression spring 38, which abuts against the bracket at its one end, and against a down-turned flange 66 of fence 34 at its other end. The abutment of bracket 40 against shoulder 64 relieves the sleeves 42 of the pressure of spring 38. Flange 66 has an opening 68 (see FIG. 6) receiving shaft 36. Fence 34 has crossbars 70 defining openings 72 which receive the respective dials and sleeves.

Figure 6:
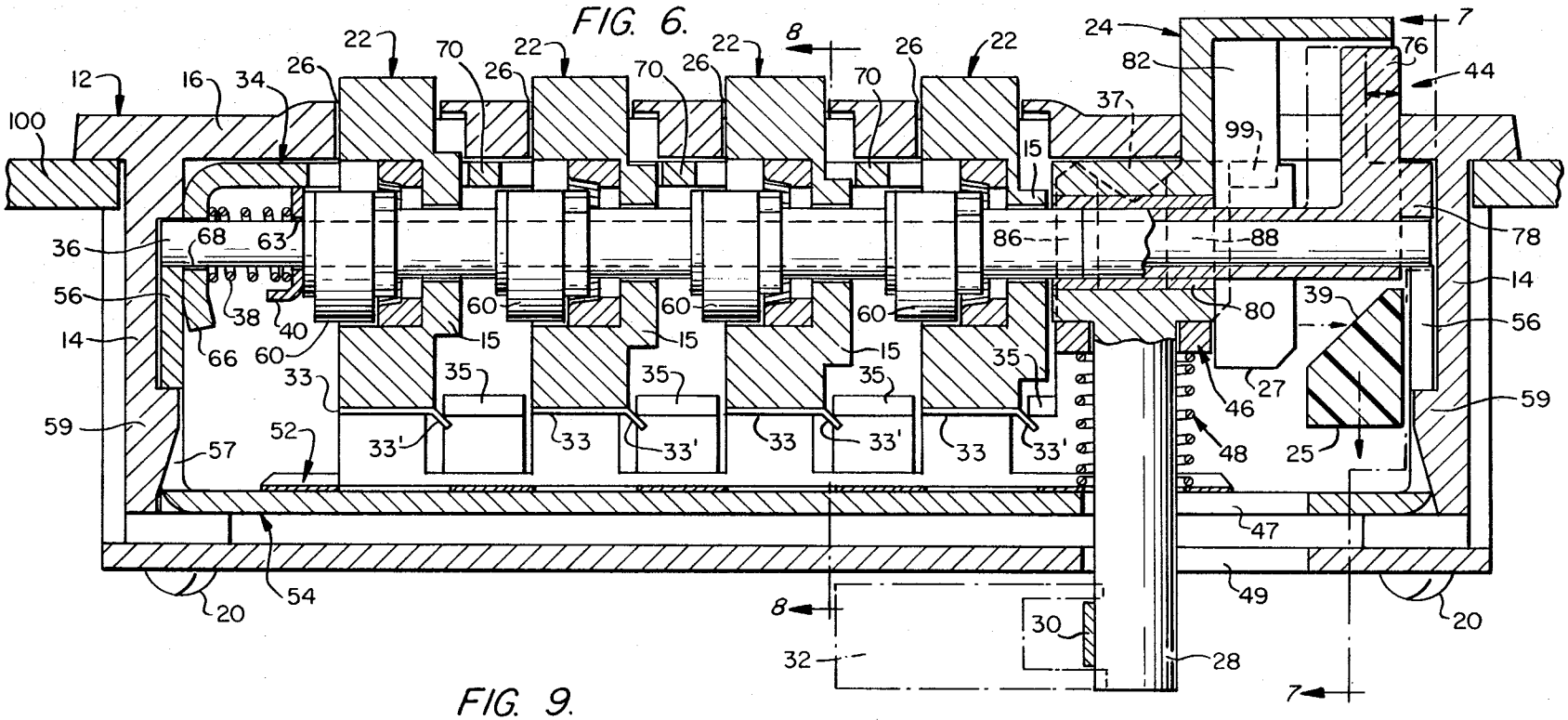
FIG. 6 is a sectional elevational view showing the lock in locked position.

The above-described construction is such that spring 38 normally urges fence 34 to the left, to the position shown in FIG. 6. In this position, except when the flats 62 on the respective sleeves all face up, as shown in FIGS. 4 and 6, the sleeve bosses 60 enter the openings 72 in fence 34 and form blocking points in conjunction with crossbars 70, preventing the fence being moved to the right. When, however, all the flats do face up as illustrated (corresponding to the on-combination setting of the lock, when all the dials are suitably rotationally orientated) the blocking points are cleared and the fence and manual actuator 24 can be moved to the right, as will be described. This type of interaction between a fence and combination sleeves is well known and need not be described in greater detail.

To the right of the sleeves and dials, a tubular section 74 of the shift member 44 is rotatably carried on the shaft 36, the shift member also having an operating flange 76 with a projection 78 that normally fits in a recess in right-hand end wall 14 of the lock casing, to prevent rotation of the shift member. Actuator 24 has a through-bore fitted with a cylindrical bearing 80 (see FIG. 6) and the tubular section of the shift member fits within bearing 80. Operating flange 76 of the shift member fits in a pocket 82 of actuator 24, in which pocket the operating flange may be moved axially and rotatably, as will be described. Actuator 24 is open on its right side to provide access to pocket 82 and allow operation of the shift member.

Figure 9:
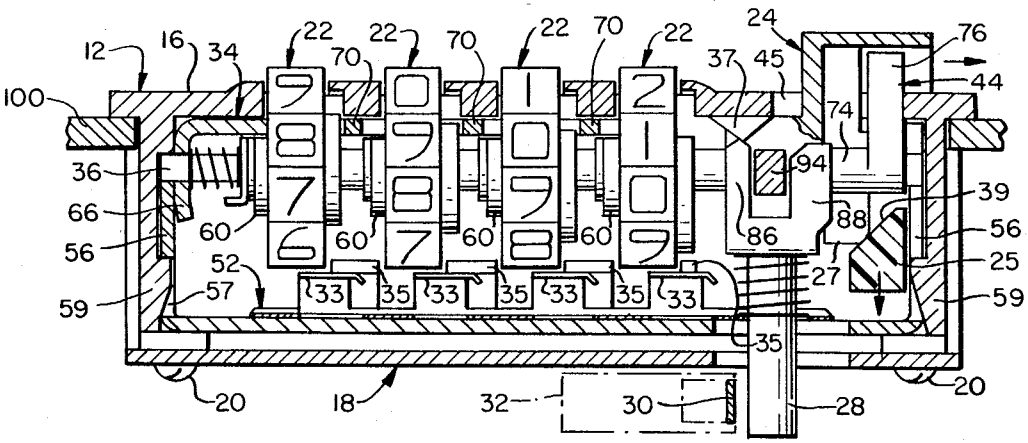
FIG. 9 is a reduced-scale elevational view with parts broken away and with the lock shown in open position, but before the opening combination is upset.
Figure 7:
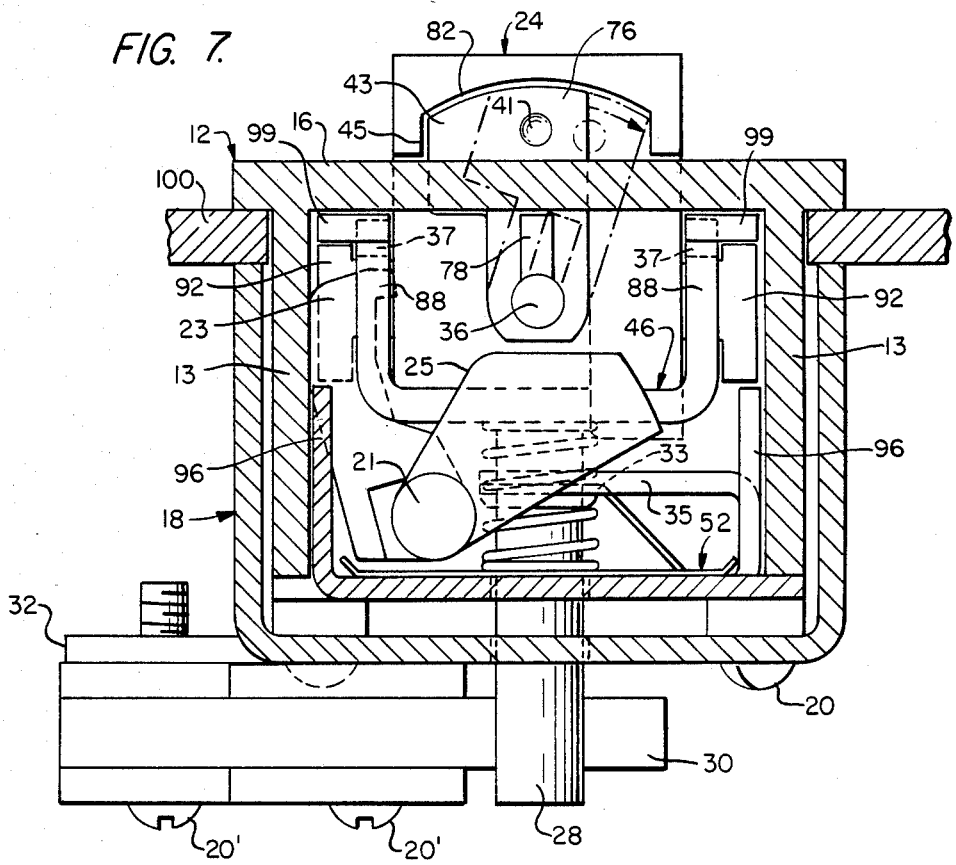
FIG. 7 is a view on line 7—7 of FIG. 6.

The manual actuator is releasably coupled to fence 34 by means of the coupling member 46. As best seen in FIGS. 4 and 9, the coupling member has a base with a central opening 84 by which it is mounted for vertical movement on post 28 of the actuator. The coupling member further has bifurcated upstanding side walls defining pairs of prongs 86, 88 which fit on opposite sides of the actuator between actuator side walls 90 and respective flat rectangular guide flanges 92 connected to the main body of the actuator by flange pieces 94, see FIGS. 4, 7 and 9. Prongs 86 and 88 straddle the respective flange pieces 94, for guidance when the coupling member moves up and down, as will be described. Coupling membet 46 is urged upwardly by spring 48 which encircles post 28 between the coupling member and dial spring member 52. When the manual actuator is moved right and left, as will be described, flanges 92 are guided by upstanding wall sections 96 of frame member 54. Right-and-left movement of the actuator post 28 is accommodated by elongate aligned slots 47 and 49 provided in the frame member and base plate, respectively.

As seen in FIGS. 4 and 5, fence 34 includes arms 98 having hooked ends 99, which, when the coupling member 46 is in the normal elevated position on post 28, and the lock is closed, engage behind the coupling member prongs 88. Thus, a coupling connection is formed between actuator 24 and fence 34 for permitting movement of these elements to the right in unison when the lock is set on-combination. In use of the lock, as will be described, the fence is uncoupled from the actuator by downward movement of the coupling member when the lock is opened. Arms 98 of the fence are supported on the actuator flanges 92 (see FIG. 7).

Figure 8:
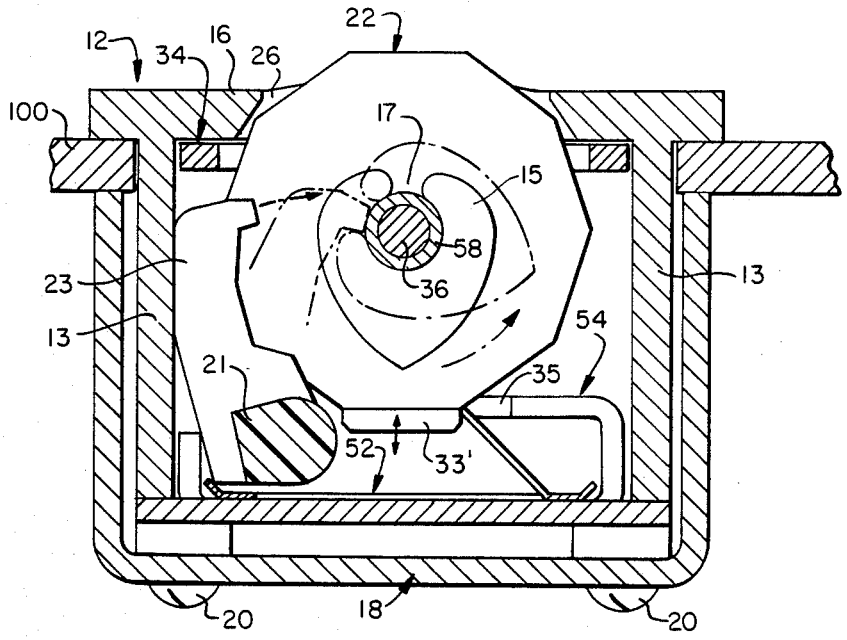
FIG. 8 is a view on line 8—8 of FIG. 6.

Each of the dials 22, as seen particularly in FIGS. 4 and 8, has a heart-shaped cam formation 15 on one face, the cam formations each having a recess 17 opposite the apex thereof. The cam formations are adapted to cooperate with cam operator 50, which is itself worked by the manual actuator 24, when the lock is opened, to constitute the upsetting means for rotating each dial from its particular on-combination orientation into another set orientation, in a manner more fully described hereinafter.

Cam operator 50 includes an elongate shaft member 21, follower arms 23, for applying pressure on the respective cam formations 15, as will be described, and a driving arm 25, in the form of a camming element, adapted to cooperate with a complementary camming element 27 formed on the bottom of actuator 24 to form drive means for the cam operator. The cam operator is disposed in parallel with shaft 36, the opposite ends of shaft member 21 being received in recesses in the casing end walls 14 (see FIG. 5) and being held in place by lugs 29 on frame member 54.

Dial spring member 52 is a generally flat plate having an opening 31 through which post 28 passes, and struck from the plate are spring arms 33 defining individual dial springs for the respective dials 22. The spring arms have flat upper surfaces and the dials are polygonal in shape defining flat, indicia-carrying facets, so that in use, with the spring member received on frame 54, the flat arm surfaces engage the respective dial facets face-to-face. The spring arms provide positive step-by-step indexing of the dials between the various indicia settings. This type of dial and dial spring assembly is disclosed in co-pending patent application Ser. No. 265,213 filed May 19, 1981 and which is commonly assigned herewith.

It will be noted, see FIGS. 4 and 6, that spring arms 33 each have one downwardly beveled edge 33′, and these edges when the lock is closed as in FIG. 6, are disposed adjacent parallel projections 35 of frame plate 54. The projections are vertically positioned relative to the spring arms to define stationary cam means for the arms. The arrangement is such that when the manual actuator is drawn to the right, thereby moving spring member 52 with it, through post 28, the spring arms are pressed down by projections 35 so as to flex the arms away from the respective dials (FIG. 9), to facilitate free rotation of the dials.

Operation of the lock will now be described in more detail.

When the lock is locked, in order to move the manual actuator from the position shown in FIG. 6 (the "first" position) dials 22 must each be rotated to the particular orientation defining the on-combination setting of the lock. This suitably orients sleeves 42 so that the flats 62 each face upwardly, thereby clearing crossbars 70 of fence 34 and releasing the fence for movement to the right by manual movement of actuator 24 and coupling member 46. As shown in FIGS. 4, 6 and 9, the prongs 86 of the coupling member have tapered upper surfaces, and when the actuator and coupling member are drawn to the right, the tapered prong surfaces engage complementary cam surfaces formed on projections 37 on the inner surface of plate 16. Continued movement of the actuator to the right, toward the position shown in FIG. 9 (the "second" position) accordingly causes the coupling member to be depressed against the force of spring 48, so as to disengage prongs 88 from the hooked arms 98 of the fence 34. The fence is then returned to its initial left-hand (locking) position by spring 38 independently of the actuator and coupling member. (If the fence were not returned to the left-hand position, crossbars 70 would be positioned over the respective sleeve flats 62 to their right, as viewed in FIGS. 6 and 9, preventing subsequent rotation of the sleeves and dials. Also, if the fence and actuator were not uncoupled, further movement of the actuator to the right would not be possible.)

Movement of the actuator to the right from its first position to its second position, as described above, is also effective to cause spring arms 33 to be cammed away from engagement with the dial peripheries, by movement under projections 35, and to move post 28 to the right, thereby releasing switch arm 30 for movement to the right which operates switch 32.

In the position of the lock shown in FIG. 9, it will be seen that the camming element 27 on the manual actuator has been brought into engagement with cam surface 39 of arm 25 on cam operator 50. Accordingly, further movement of the manual actuator to the right beyond the second position illustrated in FIG. 9, causes the camming member 27 to press arm 25 down, thereby rotating the cam operator 50 in a clockwise direction as viewed in FIGS. 7 and 8. Follower arms 23 are accordingly rotated from the position shown in solid line in FIG. 8, so that the hooked ends of the arms apply pressure against the peripheries of the respective cam formations 15. Application of pressure to the cam formations 15 is effective, due to the heart-shape thereof, to rotate each cam formation from the particular orientation in which it was disposed to open the lock (irrespective of what this orientation may be) to another set orientation in which the hooked ends of arms 23 engage in the recesses 17, as shown in dotted line in FIG. 8. Thus, the on-combination setting of the dials is upset. Preferably, in the set orientation to which each dial is rotated by the respective arms 23, a like indicium, e.g., "0", is displayed on each dial in uppermost position in the respective openings 26.

In the extreme right-hand position of actuator 24 (illustrated only in FIG. 3) arm 25 is fully depressed and prongs 86 of coupling element 46 have snapped to the right of projections 37. In this position, prongs 86 and 88 straddle the hooked ends 99 of the fence. Actuator 24 may then be manually returned to its initial left-hand position (the first position), as shown in FIG. 6. In the return movement, prongs 86 snap back over projections 37 reengaging prongs 88 to the left of hooks 99 of the fence. Also, arm 25 of the cam operator is released and arm 32 of the switch is returned to its initial position. It will be noted that the actuator has a "dead bolt" type action in moving post 28 left and right between the locked and unlocked positions. Also, the cooperation of the coupling member prongs with projections 37 provides a detent effect in both right and left movement of the actuator.

To reopen the lock, the dials must be returned to the on-combination setting. This action may cause the ends of follower arms 23 to be cammed out of recesses 17, allowing the cam operator 50 to drop back to its initial position. Alternatively, the cam operator may drop back under gravity.

In practical embodiments of the invention, the overall stroke of the manual actuator from its extreme left-hand position (the first position) through the FIG. 9 or second position and beyond, to the extreme right-hand position in which the dials have been rotated by arms 23, may be quite small (a fraction of an inch). Also, there is a resistance to movement of the actuator caused, for example, by the camming actions of spring arms 33 with projections 35 and prongs 86 with projections 37. Effectively, therefore, manual operation of the actuator, e.g., by thumb pressure, may result in a continuous movement of the actuator from its extreme left-hand position to its extreme right-hand position, which movement is effective both to open the lock and to upset the dials.

The on-combination setting of the lock may be changed, by manually moving the sleeves 42 to the left, as shown in FIG. 6, by means of the shift member 44, in order to uncouple the dials from the sleeves, and then by rotating one or more of the dials relative to its respective sleeve. Movement of the shift member and sleeves to the left can only be effected when the dials are set on-combination, for otherwise, the sleeve bosses 60 are in blocking relation with fence 34, precluding axial movement of the sleeves. Movement of the shift member may be effected, for example, by applying pressure in recess 41 (FIG. 7) of the operating flange, with a sharp-pointed instrument, such as a pen, or the like, to move the shift member axially. Such movement brings projection 78 out of its receiving recess in end wall 14, allowing the operating flange 76 of the shift member to be pivoted clockwise in pocket 82, thereby misaligning the projection 78 from the receiving recess. When the sleeves are moved to the left and uncoupled from the dials, flats 62 move under the crossbars 70 so as to prevent the sleeves from rotating. The shift member may then be released with the projection 78 abutting the interior of wall 14 and holding the sleeves 42 out of coupling engagement with the dials, so that the new combination may be set. Return, counterclockwise movement of the shift member then allows spring 38 to snap the sleeves back into coupling engagement with the dials, and projection 78 is returned to its receiving recess in wall 14. Counterclockwise movement of the shift member is limited to a position aligning projection 78 and its receiving recess, by engagement of shift member lug 43 against wall 45 of the actuator pocket, see FIG. 7.

It will be appreciated from the above description of one preferred embodiment, that the invention provides a combination lock in which the combination dials or the like may be automatically moved out of their on-combination setting when the lock is opened, thereby endowing the lock with an additional degree of security compared with locks which remain on-combination when opened. Further, the lock has a "scramble feature"; namely, the capability of being locked from the open condition even though the dials are not set on-combination. In the illustrated embodiment, this is effected by the right-to-left movement of actuator 24, as previously described.

The ability of locks in accordance with the invention to upset and obscure the on-combination setting when the lock is opened, allows multi-dial combination locks to be used in applications previously considered unsuitable for such locks, for example, for security considerations. Such applications include, for example, the locking of file cabinets, desks, electrical equipment and the like.

While only a single preferred embodiment of the invention has been described herein in detail, the invention is not limited thereby and modifications may be made within the scope of the attached claims. For example, locking actions other than the specific locking action described (using the interaction between a fence and combination sleeves with bosses and flats) may be employed in locks made in accordance with the invention. Additionally, while in the illustrated embodiment post 28 is used to operate an electric switch in its right-and-left movement, such movement of the post may also be used to perform a mechanical latching and unlatching function. The post may, for example, be configured to latch and unlatch a hasp or the like.

I claim:

1. A combination lock including a plurality of combination dials each of which must be disposed in a particular rotational orientation in order to open the lock, a movable locking member released by the dials for movement only when the dials are each in said particular orientation, a manual actuator associated with the locking member for opening the lock when the locking member is released, coupling means between the locking member and the manual actuator, means for releasing the coupling means responsive to movement of the actuator from a first to a second position when opening the lock, and upsetting means operatively connected between the manual actuator and at least one of the dials for rotating the dial out of said particular orientation by movement of the manual actuator beyond the second position.

2. A combination lock as defined in claim 1, wherein the upsetting means is adapted to rotate each of the dials out of the particular orientation required for opening the lock when the manual actuator is moved beyond the second position.

3. A combination lock as defined in claim 2 including biasing means urging the locking member toward locking position, so that the biasing means returns the locking member to locking position prior to operation of the upsetting means.

4. A combination lock as defined in claim 2, wherein the upsetting means is adapted to rotate each dial from said particular orientation into another set orientation.

5. A combination lock as defined in claim 4, wherein the upsetting means includes a cam formation on each dial and a cam operator worked by the manual actuator when the actuator is moved beyond the second position, the cam operator including a follower for each cam formation adapted to engage the cam formation when the actuator is moved as aforesaid and to cam the dial into the set orientation irrespective of the particular orientation of the dial.

6. A combination lock including a locking member controlled by combination dials, an actuator associated with the locking member and which can only be moved to open the lock when the dials are disposed in a particular rotational orientation releasing the locking member for movement, biasing means urging the locking member toward a locking position, coupling means between the locking member and the manual actuator, and means for releasing the coupling means when the lock is opened by movement of the actuator, whereby the locking member is returned to locking position by the biasing means independently of the manual actuator.

7. A combination lock as defined in claim 6, wherein the coupling means includes a coupling member connected with the actuator and fixed cam means for engaging the coupling member responsive to movement of the actuator when opening the lock, and for moving the coupling member out of coupling connection with the locking member in a direction perpendicular to the direction of movement of the locking member.

8. A combination lock having a plurality of axially aligned rotary combination dials which must each be disposed in a particular rotational orientation to enable the lock to be opened, combination sleeves releasably coupled to the respective dials for rotation therewith, a manual actuator for opening the lock when the dials are disposed as aforesaid, and a manually operable shift member for axially moving the sleeves out of coupling engagement with the dials when the dials are disposed as aforesaid, characterized in that the shift member has an operating portion disposed in a pocket formed in the manual actuator, the pocket being accessible from one side of the actuator to permit operation of the shift member.

9. A combination lock as defined in claim 8, wherein the sleeves are carried in axially adjacent positions on a shaft, and the shift member includes a tubular section mounted on the shaft adjacent a terminal one of the sleeves, the operating portion comprising a flange extending from the tubular section into the pocket in the manual actuator, the tubular section being movable axially on said shaft to move the sleeves out of engagement with the respective dials responsive to movement of the flange in said pocket.

10. A combination lock as defined in claim 9, wherein the flange has a projection received in a recess in an end wall of a casing of the lock when the sleeves are coupled to the dials, the projection being moved out of the recess upon movement of the shift member to uncouple the dials and sleeves, and the flange of the shift member being rotatable in said pocket, when the dials and sleeves are uncoupled, to a position misaligning the projection and recess, thereby holding the dials and sleeves out of coupling engagement.

11. A combination lock as defined in claim 10 including complementary formations on the shift member flange and on the interior of the manual actuator respectively for limiting return rotation of said flange in said pocket from said position to an amount whereby said projection and said recess are mutually realigned.

12. A combination lock including a plurality of manually movable rotary combination dials which must each be disposed in a particular orientation in order for the locked to be opened, the particular orientations of the respective combination dials together defining an opening combination of the lock, the dials being mounted in axially adjacent positions on a shaft for rotation about the axis of the shaft, a manual actuator capable of movement from a locked position to an unlocked position only when the dials are disposed in the particular orientations defining said opening combination, and upsetting means for rotating said dials from said particular orientations into other set orientations when the lock is opened, thereby upsetting the opening combination of the lock, said upsetting means including a cam formation on each dial and a cam operator having a follower for each cam formation, the cam operator comprising an elongate member mounted for pivoting movement about an axis parallel to said shaft, the followers comprising arms extending from said elongate member to engage the respective cam formations, and drive means connected between the manual actuator and said cam operator for pivoting said elongate member and causing the arms to cam the dials into their said other set orientations responsive to movement of the manual actuator when the lock is opened, a locking member controlled by the combination dials, and coupling means between the manual actuator and the locking member, and wherein the manual actuator is movable from a first position to a second position, when the combination dials are in the particular orientations to open the lock, for releasing the coupling means, and the manual actuator is movable beyond the second position to operate said drive means.

13. A lock as defined in claim 12, wherein the drive means comprises a camming element associated with the manual actuator and a complementary camming element associated with the elongate member, the camming elements being effective to translate linear movement of the manual actuator into pivoting movement of the elongate member.

14. A lock as defined in claim 12, the dials being rotatably coupled to sleeves carried on the shaft, the sleeves including blocking portions adapted to cooperate with complementary blocking formations on the locking member and prevent movement of the locking member out of a locking position when the dials are disposed other than in the particular orientations which permit opening of the lock, the blocking portions of the sleeves clearing the blocking formations of the locking member when the dials are disposed in said particular orientations, to allow the locking member to be moved from its locking position.

15. A lock as defined in claim 14, wherein the locking member comprises a substantially planar fence having crossbars defining openings in which the dials are received, the crossbars defining said blocking formations, and the blocking portions of the sleeves comprising bosses aligned with said openings when the fence is in long position, each boss having a flat over which one of said crossbars can pass when the sleeve is suitably oriented.

16. A lock as defined in claim 15, wherein the manual actuator is movable from said first position in opposition to biasing means to move the locking member away from its locking position toward an unlocking position wherein the crossbars are aligned with said flats, thereby preventing rotation of the sleeves and dials, further movement of the manual actuator being effective firstly for uncoupling the locking member therefrom whereby the locking member is returned to the locking position by the biasing means so as to free the sleeves and dials for rotation and secondly to effect rotation of each dial into its set orientation through said drive means and cam operator.

17. A lock as defined in claim 12 including a dial spring for each dial, the dial springs engaging the respective dial peripheries for providing rotary indexing movements of the dials, and means for moving the dial springs out of contact with the respective dials responsive to movement of the manual actuator when opening the lock, to facilitate rotation of each dial into its set orientation.

18. A lock as defined in claim 17, wherein the dial springs are formed on a common spring member and the means for moving the dial springs out of contact with the dials includes means for connecting the spring member for movement with the manual actuator when the lock is opened and stationary cam means for engaging the dial springs and flexing them away from the dials when the spring member is moved with the manual actuator.

19. A combination lock including a plurality of manually movable rotary combination dials which must each be disposed in a particular orientation in order for the locked to be opened, the particular orientations of the respective combination dials together defining an opening combination of the lock, the dials being mounted in axially adjacent positions on a shaft for rotation about the axis of the shaft, a manual actuator capable of movement from a locked position to an unlocked position only when the dials are disposed in the particular orientations defining said opening combination, and upsetting means for rotating said dials from said particular orientations into other set orientations when the lock is opened, thereby upsetting the opening combination of the lock, said upsetting means including a cam formation on each dial and a cam operator having a follower for each cam formation, the cam operator comprising an elongate member mounted for pivoting movement about an axis parallel to said shaft, the followers comprising arms extending from said elongate member to engage the respective cam formations, and drive means connected between the manual actuator and said cam operator for pivoting said elongate member and causing the arms to cam the dials into their said other set orientations responsive to movement of the manual actuator when the lock is opened, a movable locking member controlled by the combination dials, biasing means urging the locking member to a locking position and coupling means between the manual actuator and the locking member, the manual actuator being movable from a first position to a second position for moving the locking member from its locking position and for releasing the coupling means, thereby allowing the biasing means to return the locking member to its locking position, and the manual actuator then being movable beyond said second position to operate said drive means, return of the actuator to the first position reengaging the coupling means.

20. A lock as defined in claim 19, wherein the coupling means includes a coupling member movable into and out of coupling engagement with the locking member in a direction perpendicular to the direction of movement of the actuator, and means for moving the coupling member responsive to movement of the manual actuator.

21. A lock as defined in claim 20, wherein the means for moving the coupling member includes spring means urging the coupling member toward engagement with the locking member, and cam means for moving the coupling member out of engagement with the locking member against the action of the spring means responsive to movement of the manual actuator from its first position to its second position.

22. A combination lock comprising a casing having a faceplate, a plurality of indicia-bearing combination dials supported for coaxial rotation on a shaft in said casing, said dials having peripheral portions exposed through corresponding openings in said faceplate for manual rotation of the dials individually, dial spring means in said casing for engaging said dials to index the same as they are rotated, a manual actuator supported in said casing for movement between a locked position and an unlocked position, said actuator having a portion exposed through a corresponding opening in said faceplate for manual movement of said actuator, locking means in said casing controlled by said dials and coupled to said manual actuator for permitting said manual actuator to move from said locked position to said unlocked position only when the dials are disposed in particular orientations so as to display at their said peripheral portions a predetermined combination of said indicia for opening the lock, said locking means comprising a locking member supported for movement in said casing in a predetermined direction in response to movement of said manual actuator toward its unlocked position, said manual actuator being coupled to said locking member by releasable coupling means that uncouple said manual actuator from said locking member in response to a predetermined amount of movement of said manual actuator toward its unlocked position, means connecting said manual actuator to said dial spring means for disengaging the dial spring means from the dials when the manual actuator is moved toward said unlocked position, and means responsive to movement of said manual actuator toward said unlocked position for rotating all of said dials to predetermined orientations at which said peripheral portions of the dials display a predetermined combination of indicia different from the combination of indicia for opening the lock, said locking member having means for biasing the same in a direction opposite to said predetermined direction, whereby said locking member moves with said manual actuator toward its unlocked position and, when uncoupled from said manual actuator, moves in the opposite direction.

23. A combination lock comprising a casing having a faceplate, a plurality of indicia-bearing combination dials supported for side-by-side coaxial rotation on a shaft in said casing, said dials having peripheral portions exposed through corresponding openings in said faceplate for manual rotation of the dials individually, dial spring means in said casing for engaging said dials to index the same as they are rotated, a manual actuator supported in said casing for movement along the length of said shaft between a locked position and an unlocked position, said actuator having a portion exposed through a corresponding opening in said faceplate adjacent to a terminal one of said dials for manual movement of said actuator, locking means in said casing controlled by said dials and coupled to said manual actuator for permitting said manual actuator to move from said locked position to said unlocked position only when the dials are disposed in particular orientations so as to display at their said peripheral portions a predetermined combination of said indicia for opening the lock, means connecting said manual actuator to said dial spring means for disengaging the dial spring means from the dials when the manual actuator is moved toward said unlocked position, and means responsive to movement of said manual actuator toward said unlocked position for rotating all of said dials to predetermined orientations at which said peripheral portions of the dials display a predetermined combination of indicia different from the combination of indicia for opening the lock.

24. A lock as defined in claim 23, wherein the last-mentioned means comprises a cam formation on a surface of each dial substantially perpendicular to said shaft, and a cam operator supported in said casing for pivotal movement about an axis substantially parallel to said shaft and having a plurality of cam followers adapted to engage said cam formations, respectively, and means responsive to movement of said actuator toward its unlocked position for causing pivotal movement of said cam operator.

25. A lock as defined in claim 23, wherein said locking means comprises a locking member supported for movement in said casing in a predetermined direction responsive to movement of said manual actuator toward its unlocked position and wherein said manual actuator is coupled to said locking member by releasable coupling means that uncouples said manual actuator from said locking member in response to a predetermined amount of movement of said manual actuator toward its unlocked position.

* * * * *